US005440645A

United States Patent [19]

Freadman

[11] Patent Number: 5,440,645

[45] **Date of Patent: * Aug. 8, 1995**

[54] COMPUTER SPEAKER

[75] Inventor: Tommyca Freadman, Goshen, N.Y.

[73] Assignee: Sparkomatic Corporation, Milford, Pa.

[ * ] Notice: The portion of the term of this patent subsequent to Mar. 1, 2011 has been disclaimed.

[21] Appl. No.: 148,107

[22] Filed: Nov. 4, 1993

Related U.S. Application Data

[63] Continuation of Ser. No. 781,433, Oct. 23, 1991, Pat. No. 5,291,559.

[51] Int. Cl.[6] ..... H04R 25/00

[52] U.S. Cl. ..... 381/188; 381/182; 381/205; 181/199

[58] Field of Search ..... 381/188, 205, 24, 86, 381/189, 182, 186, 88, 90; 181/141, 144, 199; 379/454, 455, 426

[56] References Cited

U.S. PATENT DOCUMENTS

| | | | |
|---|---|---|---|
| 3,944,020 | 3/1976 | Brown . | |
| 4,042,791 | 8/1977 | Wiseman . | |
| 4,303,807 | 12/1981 | Sato | 381/205 |
| 4,441,577 | 4/1984 | Kurihara | 381/86 |
| 4,445,228 | 4/1984 | Bruni | 381/86 |
| 4,450,495 | 5/1984 | Naruki . | |
| 4,553,630 | 11/1985 | Ando . | |
| 4,811,406 | 3/1989 | Kawachi | 381/86 |
| 4,967,871 | 11/1990 | Komatsubara . | |

OTHER PUBLICATIONS

"Powered Speakers for Multimedia" from New Media, Apr., 1993 issue (pp. 32–34).

*Primary Examiner*—Curtis Kuntz
*Assistant Examiner*—Huyen D. Le
*Attorney, Agent, or Firm*—Rosenman & Colin

[57] ABSTRACT

A computer speaker assembly 22 is disclosed and includes a tweeter or high-frequency speaker 72 which may be selectively moved in relation to a mid-range-woofer speaker 30. Such movement is accomplished by means of a gear 64 and detent 62 arrangement.

8 Claims, 3 Drawing Sheets

COMPUTER SPEAKER

This application is a continuation of Application Ser. No. 07/781,433 filed on Oct. 23, 1991, now U.S. Pat. No. 5,291,559.

BACKGROUND OF THE INVENTION

1. Field of the Invention

This invention generally relates to a computer speaker and, more particularly, to a computer speaker assembly having a mid-range-woofer and a high-range speaker and which is adapted to be movable from a first closed and stored position to a number of desired operative open positions.

2. Discussion

Speakers are used in a variety of applications to convert an electrical signal to an audio output. Recent advances in computer technology have created "multi-media" computer systems which allow a user to interact with the computer in a variety of different ways. For instance, many of these multi-media computers allow a user to input data by means of a standard keyboard as well as through the: use of written text. Moreover, these computer systems provide information to the user by means of the traditional monitor or cathode ray tube (CRT) as well as through various audio signals.

While such multi-media computer systems have gained wide popularity, the quality of the audio output signal has been quite poor. The poor audio quality has been due to a number of factors including the use of highly compressed data, such as that associated with the reduced instruction set computing (RISC) architectures.

These highly compressed architectures provide an increase in computing speed by reducing the amount of data that needs to be processed by the central processor. While such reduced instruction set architectures have allowed large amounts of data to be efficiently processed, the use of such compressed data in conjunction with a audio speaker has resulted in poor audio quality, since only a relatively small amount of the original audio data has been provided to the speaker for audio reproduction. There is therefore a need to provide a speaker for use with such a multi-media computer system; which will accurately form an audio signal from a minimal amount of input audio data; which is relatively compact in shape so as to be capable of being used in relatively close spaces; and which has selectable and modifiable output energy characteristics which allow the output audio signal to be tailored to a specific audio environment.

SUMMARY OF THE INVENTION

It is, therefore, a primary object of this invention to provide a speaker for use in combination with a computer.

It is another object of this invention to provide a computer speaker assembly including a mid-range-woofer speaker and a tweeter or high frequency speaker.

It is another object of this invention to provide a computer speaker which is relatively compact in shape and which is movable from a closed storage position to a selectable open position.

It is yet another object of this invention to provide a computer speaker assembly having both a mid-range-woofer and a high-range speaker, which are movably coupled and which allow computer generated signals to be audibly transmitted to a computer user.

According to one aspect of the present invention, a speaker assembly is provided and comprises a first speaker; a first speaker housing adapted to removably receive the first speaker while providing a pair of arcuate channels on opposite edges of said housing; a second speaker; a second speaker housing adapted to removably receive the second speaker and having a pair of arcuate flanges formed on opposite sides of the second housing, each of the arcuate flanges being adapted to movably cooperate with a unique one of the arcuate channels, thereby allowing the second speaker housing to be movably coupled to the first speaker housing; and gear means, positioned between the first and second speaker housing, for allowing the second speaker housing to be fixed at a desired position with respect to the first speaker housing.

Further objects, features and advantages of the invention will become apparent from a consideration of the following description and claims, when taken in conjunction with the accompanying drawings.

BRIEF DESCRIPTION OF THE DRAWINGS

Various advantages of the present invention will become apparent to those skilled in the art by reading the following specification and by reference to the following drawings in which.

DETAILED DESCRIPTION OF THE INVENTION

Figure 1:
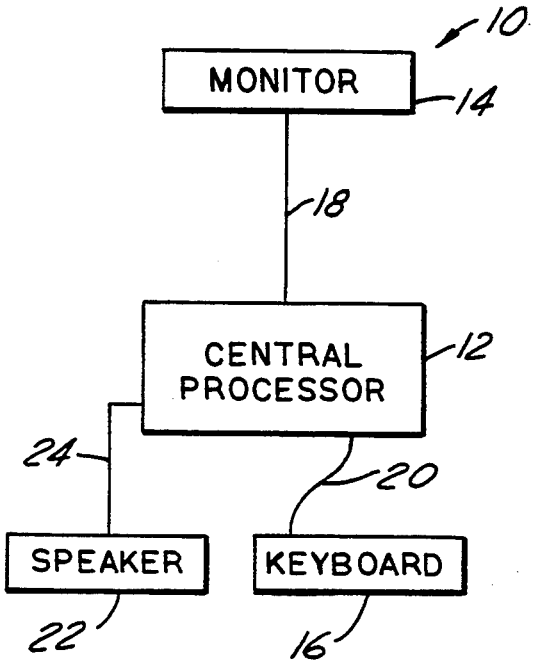
FIG. 1 is a block diagram illustrating the use of the speaker of the preferred embodiment of this invention in combination with a typical multi-media computer system.

Referring now to FIG. 1 there is shown a typical multi-media computer system 10 including a central processor 12 coupled to a monitor 14 and a keyboard 16 by means of respective buses 18 and 20. Normally, a typical user of system 10 inputs data to processor 12 by means of typical keyboard 16, and data and other information is provided to the user, by means of monitor or cathode ray tube 14.

In multi-media applications contemplated by the preferred embodiment of this invention, central processor 12 is coupled to a speaker 22, made in accordance with teachings of the preferred embodiment of this invention, by means of bus 24. In this manner, processor 12 generates electronic signals along bus 24 to speaker 22. Upon receipt of these signals, speaker 22 produces audio signals thereby allowing computer system 10 to audibly interact with a typical user.

Figure 5:
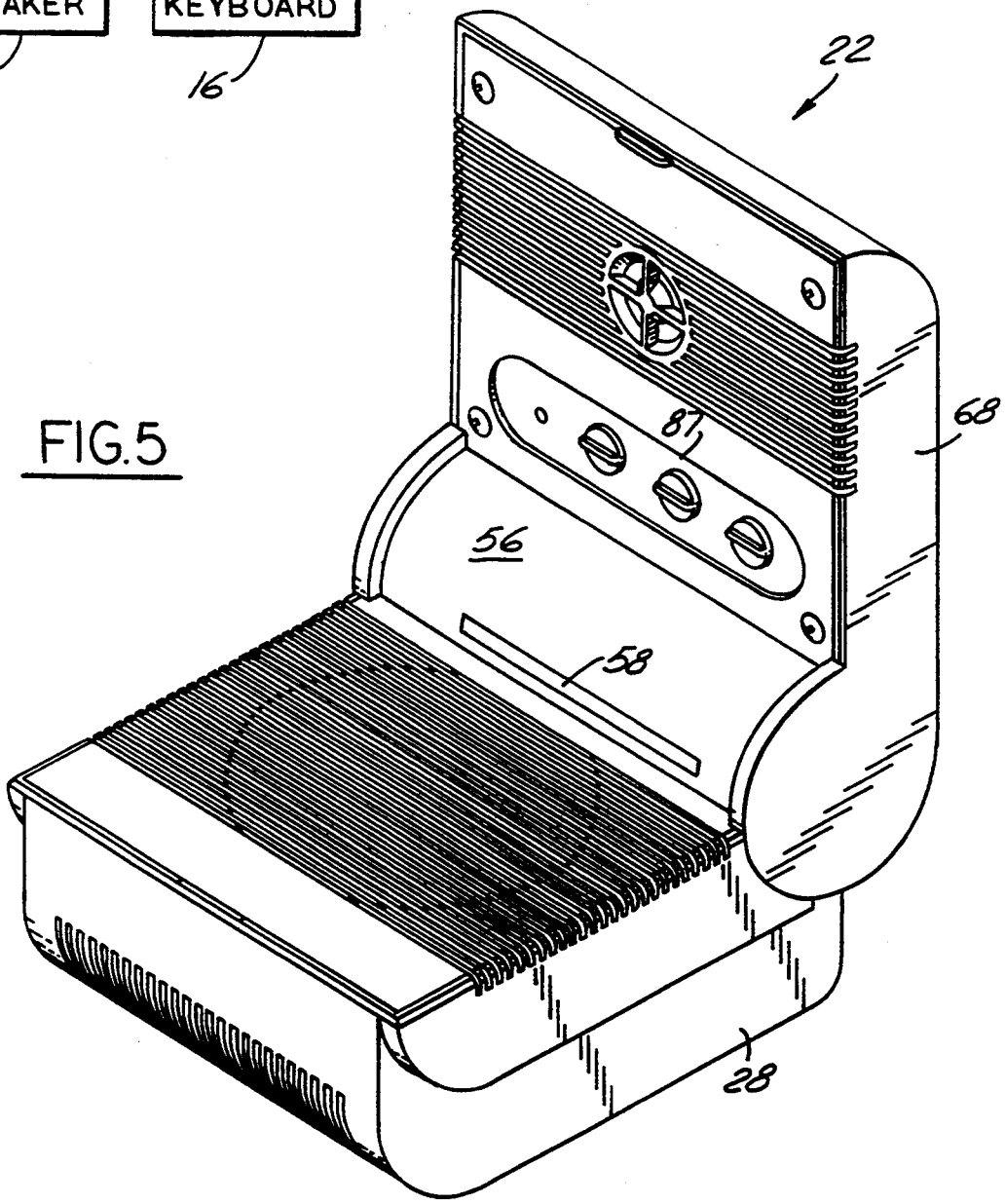
FIG. 5 is a perspective view of the speaker of the preferred embodiment of this invention.
Figures 2, 3:
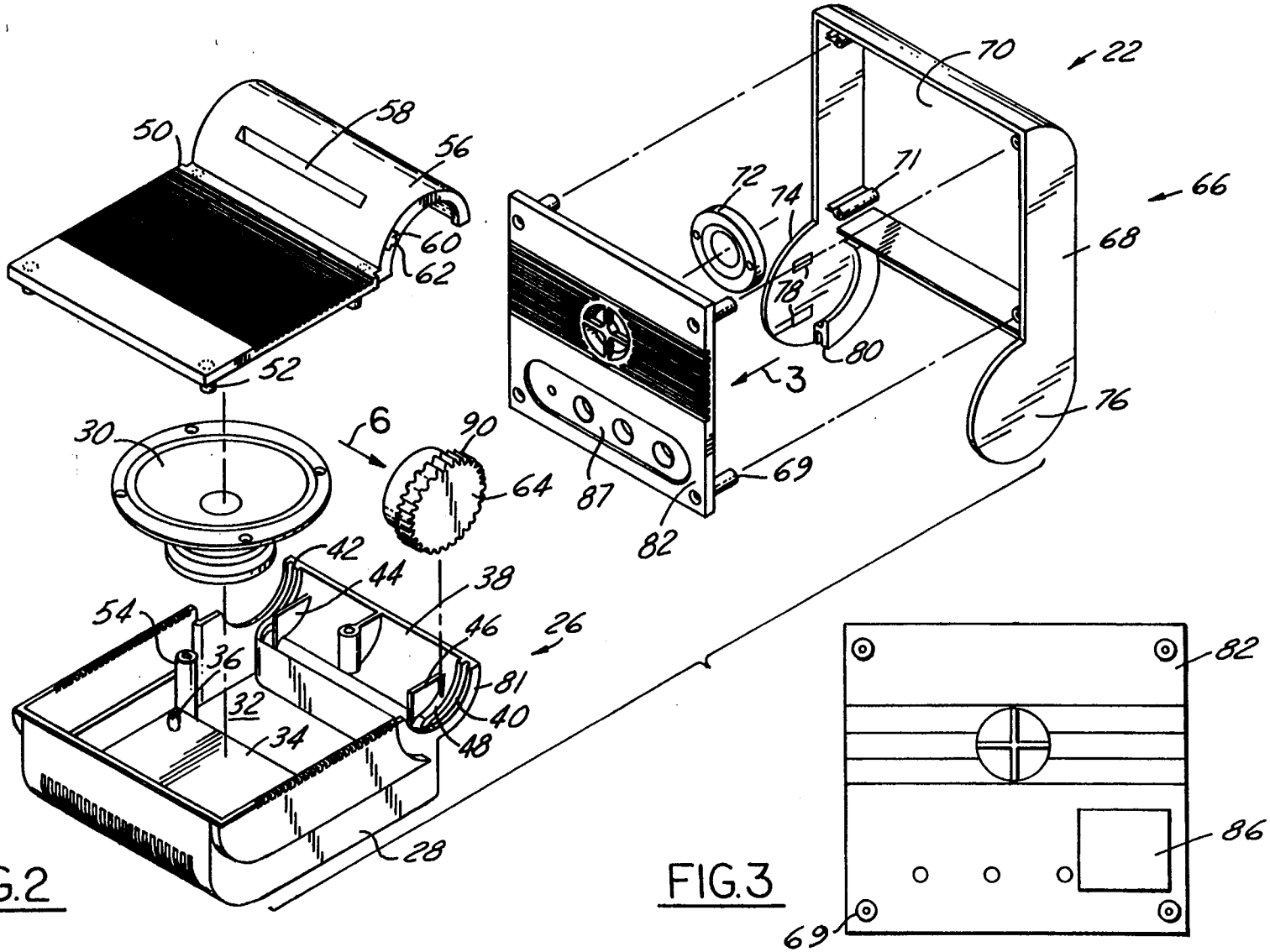
FIG. 2 is a exploded perspective view of the speaker of the preferred embodiment of this invention.
FIG. 3 is a view of a portion of the speaker of the preferred embodiment of this invention, taken in the direction of arrow 3 in FIG. 2.
Figure 4:
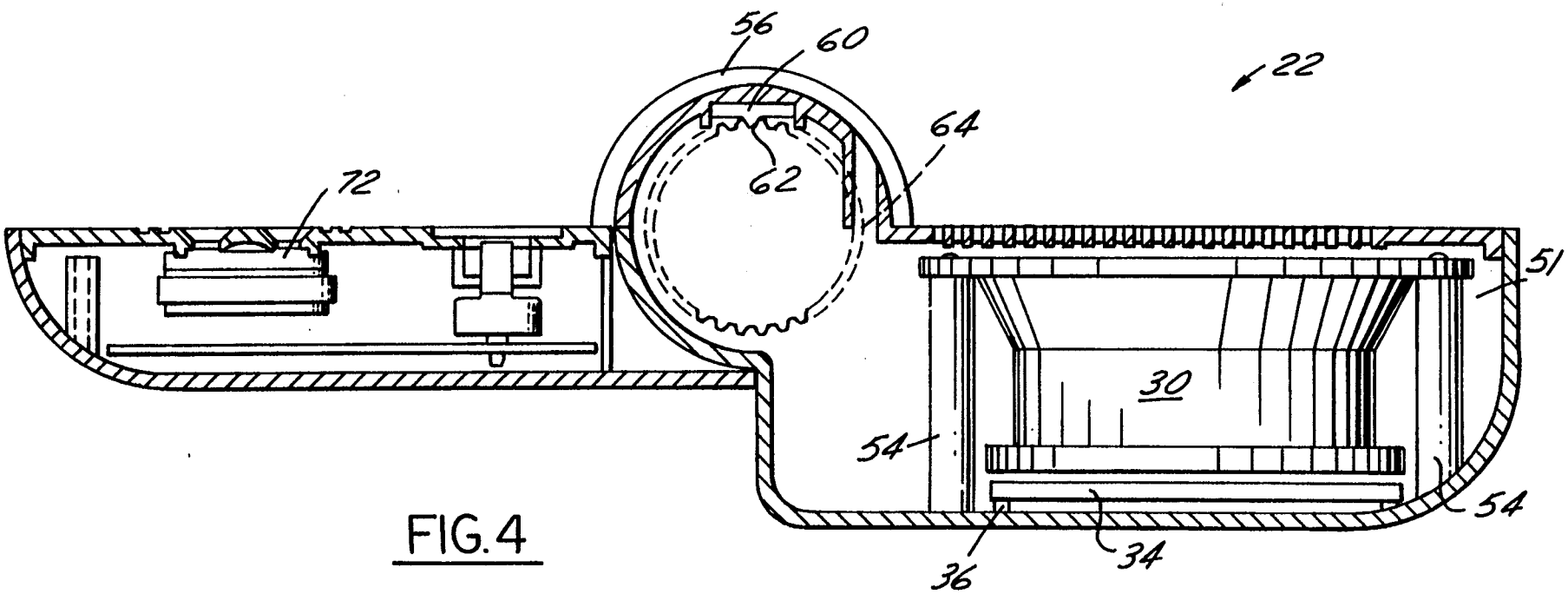
FIG. 4 is a side sectional view of the speaker of the preferred embodiment of this invention, shown in its full open position.
Figure 6:
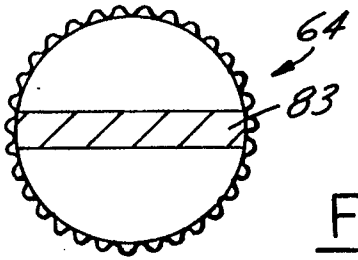
FIG. 6 is a view of a portion of the speaker of the preferred embodiment of this invention, taken in the direction of arrow 6 in FIG. 2.

Referring now to FIGS. 2, 4 and 5, there is shown a speaker 22 made in accordance with the teachings of the preferred embodiment of this invention. As shown, speaker or speaker assembly 22 includes a first speaker housing 26 having a first or bottom member 28 which is adapted to receive a typical mid-range-woofer or bass speaker 30.

More particulary, member 28 provides a generally rectangular first portion 32 which is adapted to selectively and removably receive the speaker 30. Moreover, member 32 is also adapted to selectively and removably receive a first printed circuit board 34 which is removably threaded or screwed to cylindrical threaded couplers 36 at each of its corners. Member 28 also includes a generally arcuate and outwardly extending flange portion 38 having generally arcuate depressions or channels 40 and 42 at each of its respective edges. Member 38 further includes substantially triangular shaped flanges 44 and 46 in close proximity to respective channels 42 and 40 and which are adapted to cooperate with their corresponding channel 42, 44 to create a gear reception space 48 between each flange 44, 46 and each respective channel 42, 40.

As further shown, first speaker housing 26 also includes a second or top member 50 which is adapted to be removably and selectively coupled to member 28 by the insertion of threaded coupling members 52 into corresponding threaded coupling members 54 and the subsequent insertion of threaded screws (not shown) into each of the corresponding members 52 and 54. As will be appreciated by one of ordinary skill in the art, it should be apparent that when member 50 overlays member 28, member 50 cooperates with member 28 to form a speaker retention cavity 51 into which speaker 30 is positioned and retained. In one embodiment of this invention, speaker 30 may be selectively secured to member 50 or alternatively, attached between each of the corresponding members 52 and 54, as shown.

Member 50 further includes a generally arcuate or outwardly extended "C" shaped portion 56 having a rectangular bass tuning slot 58 longitudinally formed therein. Member 56 further has, at each of its edges, a spring 60 coupled to a downwardly protruding detent 62 on the underside or interior surface thereof. Detent 62 selectively engages a gear 64 in a manner to be explained.

Furthermore, assembly 22 also includes a second speaker housing 66 having a bottom or first member 68 forming or providing a rectangular speaker recess or receptacle portion 70 into which a tweeter or high frequency speaker 72 is made to reside. Moreover, member 68 further includes generally circular and outwardly protruding lobe portions 74 add 76, each having outwardly protruding gear detents 78, which cooperate to securely fasten a gear 64 to the interior surface of each lobe 74 and 76.

Lastly, member 68 also includes a pair of generally arcuate flanges 80 which are each adapted to receive the outermost portion 81 of a unique one of the channels 40, 42 thereby movably or slidably residing within or movably coupled to a unique one of the channels 40 and 42. In this manner, it should be apparent to one of ordinary skill in the art, that member 68 may be movably or slidably coupled to member 28 such that member 68 is capable of being moved from a first closed position in which member 68 is made to overlay member 12 to a second and fully open position, such as shown in FIG. 4, or to many other selectable positions between these aforedescribed closed and opened positions.

Moreover, second housing 66 also includes a top or second member 82 which is adapted to be removably secured to member 68 by means of threaded attachment members 69 and 71. In this manner, it should apparent to one of ordinary skill in the art, that members 82 and 68 cooperate to define a speaker retention cavity into which the tweeter or high frequency speaker 72 may be placed.

As best shown in FIG. 3, a printed circuit board 86 may be further coupled to the interior or back surface of member 82 and is adapted to be electrically connected to both speaker 72 and to printed circuit board 34, by means of a bus (not shown) which passes either over or alongside gear 64 or, in the preferred embodiment of this invention, passes within cut-out passage 83 formed within each gear 64. It should be realized that passage 83 allows the electric bus to connect boards 86 and 34 and ensures that the bus doesn't become tangled or intertwined with other portions of assembly 22. Further, it should be realized that board 34 is also coupled to speaker 30 by this bus and therefore, the bus allows for the electrical connection of speaker 30 and 72 and ensures that this connection does not become broken or interrupted as the second housing 66 is moved from a closed to a variety of different open positions, since the bus is substantially prevented from becoming tangled or broken during these movements.

Moreover, it should be realized that printed circuit boards 34 and 86 may include various pre-amplifiers and equalization components as are known in the art and that they may also include electronic resonance control correction circuitry (ERCC). Both the ERCC circuitry and the pre-amplifiers and equalization components are described in U.S. Pat. No. 4,429,181 issued on Jan. 31, 1984 to the Applicant and fully incorporated herein by reference. Moreover, these boards 34 and 86 also, as known, are adapted to receive electric power and are coupled to processor 12 in order to receive the electrical signals to be made audible. Boards 34 and 86 are also, as known, coupled to a typical control panel 87 which controls the audio output level (i.e. volume) as well as overall balance between the two speakers.

As best shown in FIGS. 2 and 4, when assembled, each of the gears 64 is made to reside within space 48, provided on each edge portion 38 of member 28. These gears 64 are securely held in place by means of detents 78 and move with member 68. Moreover, detent 62 is made to frictionally engage gear 64 and as member 68 is moved, actually traverses the outer surface or perimeter of gear 64. When it is desired to place member 68 at a desired position relative to member 28, detent 64 is made to reside within a gear surface that is between a selected pair of teeth 90. In this manner, member 68, and more particularly second housing 66, may be fixedly positioned at a desired location relative to the first housing 26 or member 28. Such movement allows a user to select the position of speaker 72, relative to speaker 30, that produces the best discernable quality of audio output signal. Such movement also allows speaker 22 to be stored in a relatively compact nature and to be usable even in close quarters. Moreover, such movement also allows for relatively fast and easy adjustments in the audio output signal as the environment or extraneous surroundings change.

It is to be understood the invention is not limited to the exact construction or method illustrated and described above, that various changes and modifications may be made without departing from the spirit and scope of the invention, as defined in the following claims.

I claim:

1. A speaker assembly comprising:

a mid-range woofer speaker;

a first speaker housing adapted to receive said mid-range woofer speaker;

a tweeter speaker;

a second speaker housing adapted to receive said tweeter speaker; and hinge means disposed between said first speaker housing and said second speaker housing for pivotally connecting and selectively positioning said second speaker housing relative to said first speaker housing between and including a closed position wherein said speakers are opposed and completely concealed from view and an open position wherein said second speaker housing is pivoted approximately 180° from the closed position and said mid-range woofer speaker and said tweeter speaker are oriented in an approximately common direction, said hinge means communicating at least one electric wire between said mid-range woofer speaker and said tweeter speaker.

2. A speaker assembly as claimed in claim 1, wherein said first speaker housing is placed on a flat horizontal surface with the woofer speaker upwardly directed and so remains independent of the position of the second speaker housing.

3. A speaker assembly as claimed in claim 1, further comprising a control panel disposed in said second speaker housing and completely concealed from view in said closed position and electrically connected to both speakers.

4. A speaker assembly as claimed in claim 1, wherein the hinge means comprises:

opposed first arcuate surfaces on opposite sides of said first speaker housing; and opposed second arcuate surfaces on opposite sides of said second speaker housing and slidably engaged with said first arcuate surfaces.

5. A speaker assembly comprising:

a mid-range-woofer speaker;

a tweeter speaker;

a first speaker housing adapted to receive said mid-range-woofer speaker and having an outwardly protruding generally arcuate flange portion with arcuate engagement surfaces at opposite edges of said flange portion;

a second speaker housing, adapted to receive said tweeter speaker and having a pair of lobes pivotally coupled to said arcuate engagement surfaces thereby allowing said second speaker housing to be pivoted from a closed position in which said second speaker housing overlays said first speaker housing, to an open position and allowing said second speaker housing to be moved to and fixed at said open position.

6. A speaker assembly as claimed in claim 5, wherein said first speaker housing is placed on a flat horizontal surface with the woofer speaker upwardly directed and so remains independent of the position of the second speaker housing.

7. A speaker assembly as claimed in claim 5, further comprising a control panel disposed in said second speaker housing and completely concealed from view in said closed position and electrically connected to both speakers.

8. A speaker assembly as claimed in claim 5, wherein one of said lobes has a passage adapted to receive at least one electric wire and to allow said electric wire to be coupled to said mid-range-woofer and to said tweeter speaker.

* * * * *